US010422086B2

(12) United States Patent
Jorgensen

(10) Patent No.: US 10,422,086 B2
(45) Date of Patent: Sep. 24, 2019

(54) SCREED CONTROL SYSTEM

(71) Applicant: Caterpillar Paving Products Inc., Brooklyn Park, MN (US)

(72) Inventor: John Eron Jorgensen, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/810,270

(22) Filed: Nov. 13, 2017

(65) Prior Publication Data

US 2019/0145063 A1 May 16, 2019

(51) Int. Cl.

| | |
|---|---|
| ***E01C 19/02*** | (2006.01) |
| ***E01C 19/48*** | (2006.01) |
| *E01C 19/00* | (2006.01) |

(52) U.S. Cl.

CPC ..... *E01C 19/48* (2013.01); *E01C 19/002* (2013.01); *E01C 19/004* (2013.01); *E01C 2301/14* (2013.01)

(58) Field of Classification Search

CPC ..... E01C 19/002; E01C 19/004; E01C 19/48; E01C 2301/14

USPC ..... 404/84.05–84.5, 118

See application file for complete search history.

(56) References Cited

U.S. PATENT DOCUMENTS

| | | | | |
|---|---|---|---|---|
| 5,484,227 | A | 1/1996 | Ikeda et al. | |
| 5,575,583 | A | 11/1996 | Grembowicz et al. | |
| 6,350,082 | B1 * | 2/2002 | Rickards | E01C 19/236 404/122 |
| 8,221,025 | B2 | 7/2012 | Buschmann et al. | |
| 8,591,146 | B2 | 11/2013 | Begley et al. | |
| 8,979,425 | B2 | 3/2015 | Graham et al. | |
| 8,998,530 | B2 | 4/2015 | Buschmann et al. | |
| 9,567,715 | B2 | 2/2017 | Pedersen et al. | |
| 2008/0226392 | A1 * | 9/2008 | Lloyd | E01C 23/065 404/72 |
| 2010/0284742 | A1 * | 11/2010 | Christ | E01C 19/48 404/118 |
| 2014/0186115 | A1 * | 7/2014 | Graham | E01C 19/4873 404/75 |
| 2015/0063907 | A1 | 3/2015 | Graham et al. | |
| 2016/0185164 | A1 * | 6/2016 | Thiesse | E01C 19/48 152/418 |

* cited by examiner

*Primary Examiner* — Raymond W Addie

(74) *Attorney, Agent, or Firm* — Schwegman, Lundberg & Woessner

(57) ABSTRACT

A screed control system for a screed system includes a controller communicably coupled to a position sensor and at least one of a screed pressure assist system, an extendable screed height system, and a tamper system. The controller is configured to receive a signal indicative of a position of an at least one extendable screed with respect to a main screed. The controller is also configured to determine a change in the position of the at least one extendable screed with respect to the main screed. The controller is further configured to control at least one of the screed pressure assist system, the extendable screed height system, and the tamper system based, at least in part, on the determination.

14 Claims, 3 Drawing Sheets

SCREED CONTROL SYSTEM

TECHNICAL FIELD

The present disclosure relates to a screed control system. More particularly, the present disclosure relates to the screed control system for a screed system associated with a construction machine.

BACKGROUND

A machine, such as a paver, includes a screed assembly installed thereon for paving an asphalt surface on ground. The screed assembly may generally be free floating with respect to a frame of the machine. As a result, a thickness of the paved surface and an angle at which the screed assembly may pave the asphalt on the ground may occur at an equilibrium of forces acting on the screed assembly from the asphalt being paved.

In many situations, the screed assembly may include a main screed and an extendable screed coupled to the main screed. The extendable screed may be adapted to increase a width of the screed assembly based on a position of the extendable screed with respect to the main screed. In such a situation, when a paving width may be changed based on an extension or retraction of the extendable screed, the forces acting on the screed assembly may also change. This change in the forces may result in variation in the thickness of the paved surface along a width of the screed assembly.

In order to maintain a desired thickness of the paved surface during change in the width of the screed assembly, one or more manual adjustments may be required to be done to the screed assembly. This may require manual intervention for adjusting the screed assembly, in turn, increasing process time, increasing machine downtime, reducing process accuracy/quality, and so on. Hence, there is a need for an improved control system for such a screed assembly.

U.S. Pat. No. 5,575,583 describes an apparatus for controlling a material feed system of a paver. The material feed system includes a feeder conveyor and a spreader auger. The apparatus includes a sensor that monitors the amount of material at the edge of the screed and responsively produces an actual material height signal. A rotary switch produces a desired material height signal indicative of a desired amount of material at the edge of the screed. A controller receives the actual and desired material height signals, determines a desired rotational speed of the auger in response to the difference between the signal magnitudes, and produces a command signal to rotate the auger at the desired speed. An electrohydraulic system receives the command signal and rotates the auger at the desired rotational speed.

SUMMARY OF THE DISCLOSURE

In an aspect of the present disclosure, a construction machine is provided. The construction machine includes a frame and a screed system configured to be movably coupled to the frame. The screed system includes a main screed, at least one extendable screed configured to be movably coupled with respect to the main screed, and a position sensor provided in association with the at least one extendable screed. The screed system also includes at least one of a screed pressure assist system operably coupled to at least one of the main screed and the at least one extendable screed, an extendable screed height system operably coupled to the at least one extendable screed, and a tamper system operably coupled to at least one of the main screed and the at least one extendable screed. The screed system further includes a controller communicably coupled to the position sensor and at least one of the screed pressure assist system, the extendable screed height system, and the tamper system. The controller is configured to receive a signal indicative of a position of the at least one extendable screed with respect to the main screed. The controller is also configured to determine a change in the position of the at least one extendable screed with respect to the main screed. The controller is further configured to control at least one of the screed pressure assist system, the extendable screed height system, and the tamper system based, at least in part, on the determination.

In another aspect of the present disclosure, a screed control system for a screed system is provided. The screed system includes a main screed and at least one extendable screed. The screed control system includes a position sensor provided in association with the at least one extendable screed. The screed control system also includes at least one of a screed pressure assist system operably coupled to at least one of the main screed and the at least one extendable screed, an extendable screed height system operably coupled to the at least one extendable screed, and a tamper system operably coupled to at least one of the main screed and the at least one extendable screed. The screed control system further includes a controller communicably coupled to the position sensor and at least one of the screed pressure assist system, the extendable screed height system, and the tamper system. The controller is configured to receive a signal indicative of a position of the at least one extendable screed with respect to the main screed. The controller is also configured to determine a change in the position of the at least one extendable screed with respect to the main screed. The controller is further configured to control at least one of the screed pressure assist system, the extendable screed height system, and the tamper system based, at least in part, on the determination.

In yet another aspect of the present disclosure, a method for controlling a screed system associated with a construction machine is provided. The method includes receiving a signal indicative of a position of at least one extendable screed with respect to a main screed. The method also includes determining a change in a position of the at least one extendable screed with respect to the main screed. The method further includes controlling at least one of a screed pressure assist system, an extendable screed height system, and a tamper system based, at least in part on the determination.

Other features and aspects of this disclosure will be apparent from the following description and the accompanying drawings.

DETAILED DESCRIPTION

Figure 1:
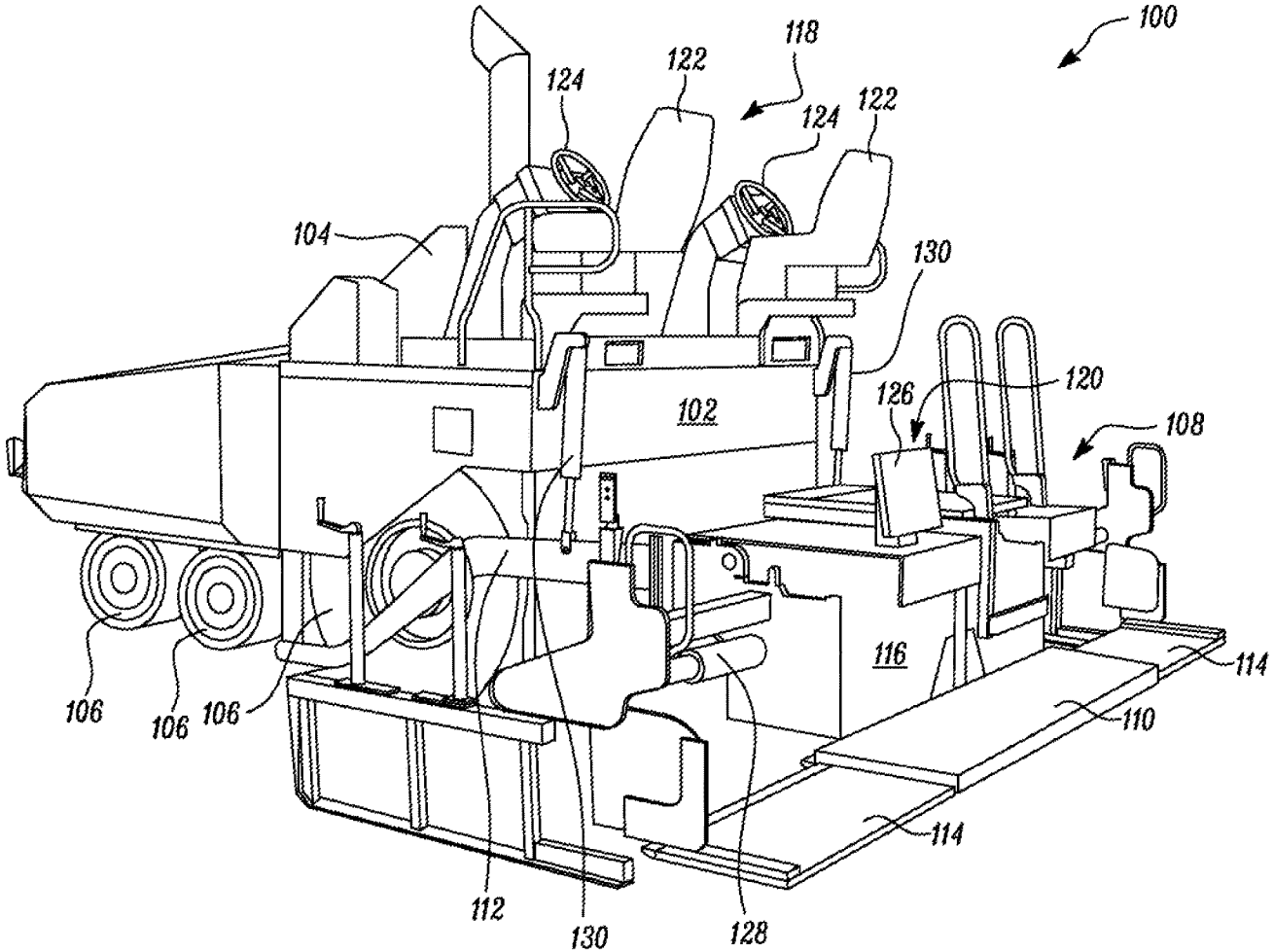
FIG. 1 is a perspective view of an exemplary construction machine, according to one embodiment of the present disclosure.

Wherever possible, the same reference numbers will be used throughout the drawings to refer to the same or the like parts. Referring to FIG. 1, an exemplary construction machine 100 is illustrated. The construction machine 100 will be hereinafter interchangeably referred to as the "machine 100". More specifically, the machine 100 is a paving machine. The machine 100 includes a frame 102. The frame 102 is adapted to support various components of the machine 100 thereon. The machine 100 includes an enclosure 104 mounted on the frame 102. The enclosure 104 is adapted to enclose a power source (not shown) therein. The power source may be any power source known in the art, such as an internal combustion engine, batteries, motor, and so on. The power source is adapted to provide power to the machine 100 for operational and mobility requirements.

The machine 100 also includes ground engaging members 106 movably coupled to the frame 102. In the illustrated embodiments, the ground engaging members 106 include wheels. In other embodiments, the ground engaging members 106 may include tracks. The ground engaging members 106 are adapted to support and provide maneuverability to the machine 100 on a ground surface. The machine 100 also includes a screed assembly 108 mounted on the frame 102. The screed assembly 108 will be hereinafter interchangeably referred to as the "assembly 108". The assembly 108 includes a main screed 110 movably mounted on the frame 102. More specifically, the main screed 110 is coupled to an end of a tow arm 112. Other end of the tow arm 112 may be pivotally connected to the frame 102 of the machine 100 in a manner for towing the assembly 108.

The assembly 108 also includes an extendable screed 114 mounted on the main screed 110. The extendable screed 114 is movably coupled to the main screed 110. In one embodiment, the main screed 110 may include a screed extension carriage 116, for mounting the extendable screed 114. In some embodiments, the extendable screed 114 may be mounted rearwardly of the main screed 110. In yet other embodiments, the extendable screed 114 may be mounted in front of the main screed 110, based on application requirements.

The machine 100 also includes a machine operator station 118 mounted on the frame 102. The machine operator station 118 is configured to control various functions associated with the machine 100 and, in some embodiments, functions associated with the assembly 108. The machine 100 also includes a screed operator station 120. The screed operator station 120 is configured to control various functions associated with the assembly 108 and, in some embodiments, functions associated with the machine 100. The machine operator station 118 may include one or more seats 122 for an operator. Further, each of the machine operator station 118 and the screed operator station 120 may include respective user interfaces 124, 126. The user interfaces 124, 126 may be configured to receive various inputs from the operator and for displaying information to the operator during operation of the machine 100 and/or the assembly 108.

Figure 2:
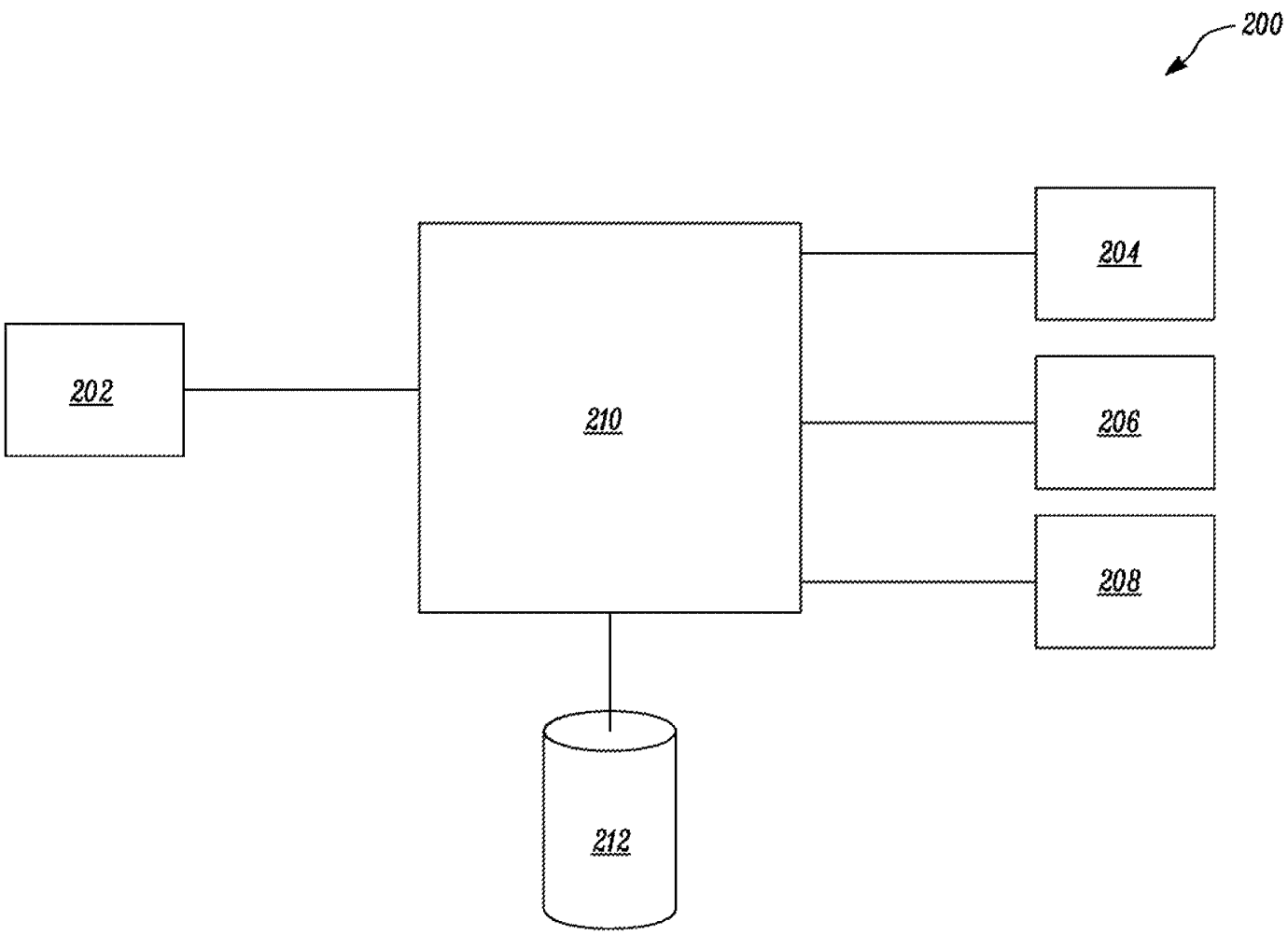
FIG. 2 is a schematic representation of a screed control system for the machine of FIG. 1, according to one embodiment of the present disclosure.

The present disclosure relates to a screed control system 200 for the assembly 108. Referring to FIG. 2, a schematic representation of the screed control system 200 is illustrated. The screed control system 200 will be hereinafter interchangeably referred to as the "system 200". The system 200 includes a position sensor 202 provided in association with the extendable screed 114. The position sensor 202 is configured to generate a signal indicative of a position of the extendable screed 114 with respect to the main screed 110. The position sensor 202 may be any position sensor known in the art, such as a cylinder position sensor associated with a hydraulic cylinder 128 (shown in FIG. 1) of the extendable screed 114, a proximity sensor, an ultrasonic sensor, a capacitive type position sensor, an inductive type position sensor, a potentiometric type position sensor, an optical type position sensor, and so on.

The system 200 also includes one or more of a screed pressure assist system 204, an extendable screed height system 206, and a tamper system 208. The screed pressure assist system 204 is operably coupled to the main screed 110 and/or the extendable screed 114. The screed pressure assist system 204 is configured to vary an effective weight of the screed assembly 108 on a paved surface or the ground surface. More specifically, the screed pressure assist system 204 may include one or more hydraulic cylinders 130 (shown in FIG. 1) coupled to the frame 102 and the screed assembly 108. The hydraulic cylinder 130 is configured to vary the effective weight of the screed assembly 108, including the main screed 110 and/or the extendable screed 114, based on a pressure thereof.

The extendable screed height system 206 is operably coupled to the extendable screed 114. The extendable screed height system 206 is configured to vary a height of the extendable screed 114 with respect to the paved surface or the ground surface. More specifically, the extendable screed height system 206 may include one or more screw drive systems (not shown) coupled to the extendable screed 114. The screw drive system may include a hydraulic motor or an electric motor, operably coupled to a chain. The chain may be operably coupled to a screw which may be further operably coupled to the extendable screed 114. An operation of the hydraulic or electric motor may change a position of the screw of the screw drive system and, thus, a position of the extendable screed 114. Accordingly, the screw drive system is configured to vary the height of the extendable screed 114, based on the position thereof.

The tamper system 208 is operably coupled to the main screed 110 and/or the extendable screed 114. The tamper system 208 is configured to vary a tamper speed and/or a tamper amplitude of the tamper system 208. In one embodiment, the tamper system 208 may be a shaft based tamper system (not shown). In such a situation, the tamper system 208 may be configured to vary a rotational speed, and/or an operational amplitude of an eccentric shaft associated with the shaft based tamper system. In another embodiment, the tamper system 208 may be a cylinder based tamper system (not shown). In such a situation, the tamper system 208 may be configured to vary an operational frequency, and/or an operational amplitude of one or more hydraulic cylinders associated with the cylinder based tamper system.

The system 200 further includes a controller 210. The controller 210 may be any control unit known in the art configured to perform various functions of the system 200. In one embodiment, the controller 210 may be a dedicated control unit configured to perform functions related to the system 200. In another embodiment, the controller 210 may be a Machine Control Unit (MCU) associated with the machine 100, an Engine Control Unit (ECU) associated with an engine of the machine 100, and so on configured to perform functions related to the system 200.

The controller 210 is communicably coupled to the position sensor 202 and one or more of the screed pressure assist system 204, the extendable screed height system 206, and the tamper system 208. Accordingly, the controller 210 is configured to receive the signal indicative of the position of the extendable screed 114 with respect to the main screed 110. Based on the received signal, the controller 210 is also configured to determine a change in the position of the extendable screed 114 with respect to the main screed 110.

Based on the determination, the controller 210 is further configured to control one or more of the screed pressure assist system 204, the extendable screed height system 206, and/or the tamper system 208. In one embodiment, the controller 210 may control the screed pressure assist system 204 in order to increase the effective weight on the screed assembly 108 based on an extension of the extendable screed 114 with respect to the main screed 110. More specifically, the controller 210 may control the pressure of the one or more hydraulic cylinders 130 associated with the screed pressure assist system 204 in order to increase the effective weight on the screed assembly 108, including the main screed 110 and/or the extendable screed 114. In another situation, based on a retraction of the extendable screed 114 with respect to the main screed 110, the controller 210 may control the screed pressure assist system 204 in order to decrease the effective weight on the screed assembly 108 by controlling the pressure of the one or more hydraulic cylinders 130 associated with the screed pressure assist system 204.

In another embodiment, the controller 210 may control the extendable screed height system 206 in order to lower the height of the extendable screed 114 with respect to the ground surface based on the extension of the extendable screed 114 with respect to the main screed 110. More specifically, the controller 210 may control the hydraulic or electric motor associated with the extendable screed height system 206 in order to lower the height of the extendable screed 114 with respect to the ground surface. In another situation, based on the retraction of the extendable screed 114 with respect to the main screed 110, the controller 210 may control the extendable screed height system 206 in order to increase the height of the extendable screed 114 with respect to the ground surface by controlling the hydraulic or electric motor associated with the extendable screed height system 206.

In yet another embodiment, the controller 210 may control the tamper system 208 in order to decrease the tamper speed and/or the tamper amplitude of the tamper system 208 based on the extension of the extendable screed 114 with respect to the main screed 110. More specifically, in order to decrease the tamper speed of the tamper system 208, the controller 210 may decrease the rotational speed of the eccentric shaft associated with the shaft based tamper system, or may decrease the operational frequency of the one or more hydraulic cylinders associated with the cylinder based tamper system. Also, in order to decrease the tamper amplitude of the tamper system 208, the controller 210 may decrease the operational amplitude of the shaft based tamper system, or the one or more hydraulic cylinders associated with the cylinder based tamper system.

In another situation, the controller 210 may control the tamper system 208 in order to increase the tamper speed and/or the tamper amplitude of the tamper system 208 based on the retraction of the extendable screed 114 with respect to the main screed 110. More specifically, in order to increase the tamper speed of the tamper system 208, the controller 210 may increase the rotational speed of the eccentric shaft associated with the shaft based tamper system, or may increase the operational frequency of the one or more hydraulic cylinders associated with the cylinder based tamper system. Also, in order to increase the tamper amplitude of the tamper system 208, the controller 210 may increase the operational amplitude of the shaft based tamper system, or the one or more hydraulic cylinders associated with the cylinder based tamper system.

The controller 210 may control the screed pressure assist system 204, the extendable screed height system 206, and/or the tamper system 208 based on any method or process known in the art. For example, in one embodiment, the controller 210 may control the screed pressure assist system 204, the extendable screed height system 206, and/or the tamper system 208 based on a dataset stored in a database 212 communicably coupled to the controller 210. The dataset may include varying values of one or more operational parameters related to the screed pressure assist system 204, the extendable screed height system 206, and the tamper system 208 for varying positions of the extendable screed 114 with respect to the main screed 110.

In another embodiment, the controller 210 may control the screed pressure assist system 204, the extendable screed height system 206, and/or the tamper system 208 based on a mathematical expression stored in the database 212. In such a situation, the controller 210 may derive varying values of one or more operational parameters related to the screed pressure assist system 204, the extendable screed height system 206, and the tamper system 208 for varying positions of the extendable screed 114 with respect to the main screed 110 based on the mathematical expression. Also, it should be noted that the controller 210 may control one or more of the screed pressure assist system 204, the extendable screed height system 206, and the tamper system 208 individually, sequentially, or simultaneously based on the position of the extendable screed 114 with respect to the main screed 110, based on application requirements.

INDUSTRIAL APPLICABILITY

Figure 3:
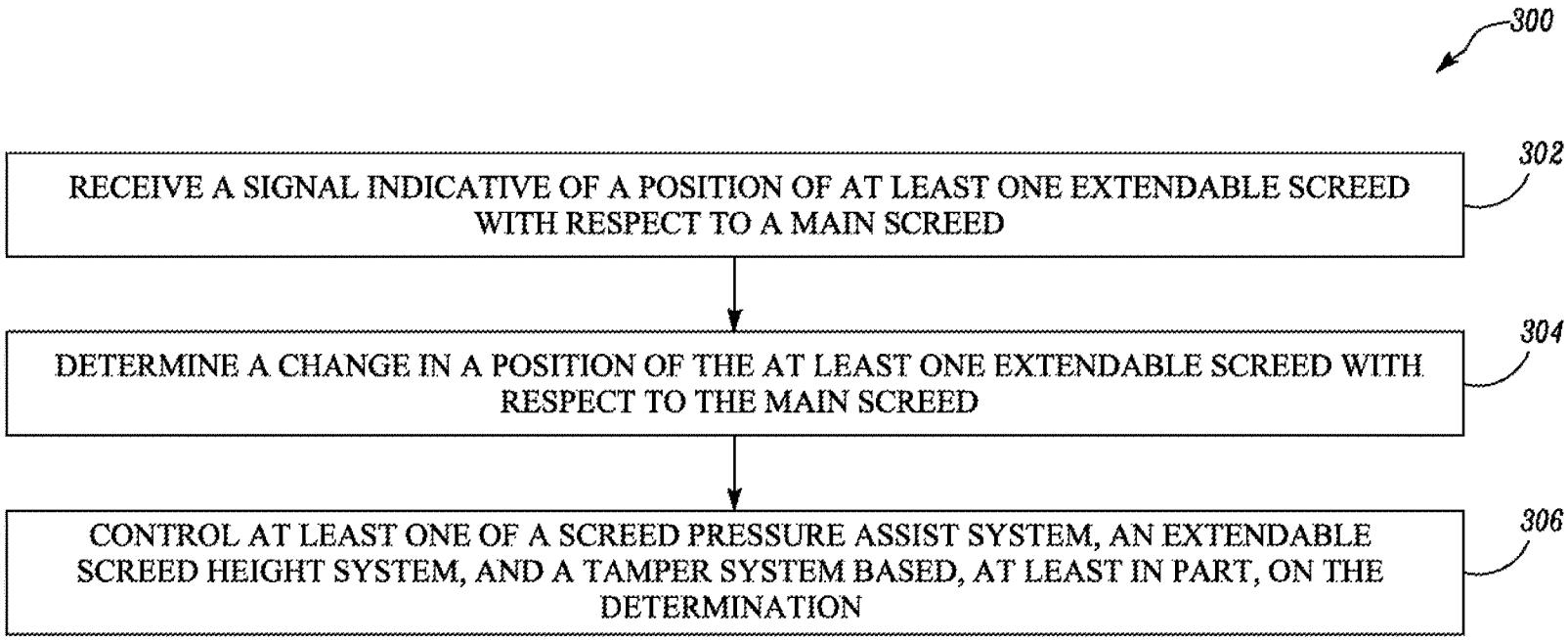
FIG. 3 is a flowchart illustrating a method of working of the screed control system of FIG. 2, according to one embodiment of the present disclosure.

The present disclosure relates to a method 300 for controlling the screed assembly 108 associated with the machine 100. Referring to FIG. 3, a flowchart of the method 300 is illustrated. At step 302, the controller 210 receives the signal indicative of the position of the extendable screed 114 with respect to the main screed 110 from the position sensor 202. At step 304, based on the received signal, the controller 210 determines the change in the position of the extendable screed 114 with respect to the main screed 110. At step 306, based on the determination, the controller 210 controls one or more of the screed pressure assist system 204, the extendable screed height system 206, and the tamper system 208 associated with the screed assembly 108.

More specifically, in one situation, controlling the screed pressure assist system 204 may include increasing or decreasing the effective weight on the screed assembly 108 based on the extension or retraction, respectively, of the extendable screed 114 with respect to the main screed 110. Additionally, or optionally, in another situation, controlling the extendable screed height system 206 may include lowering or raising the height of the extendable screed 114 with respect to the ground surface based on the extension or retraction, respectively, of the extendable screed 114 with respect to the main screed 110. Additionally, or optionally, in yet another situation, controlling the tamper system 208 may include decreasing or increasing the tamper speed and/or the tamper amplitude of the tamper system 208 based on the extension or retraction, respectively, of the extendable screed 114 with respect to the main screed 110.

The screed control system 200 provides a simple, efficient, and cost effective method of controlling various systems associated with the screed assembly 108, such as the screed pressure assist system 204, the extendable screed height system 206, and/or the tamper system 208, based on the extension and retraction of the extendable screed 114 with respect to the main screed 110. As such, the system 200 may limit manual intervention to control the screed pressure assist system 204, the extendable screed height system 206, and/or the tamper system 208 based on the position of the extendable screed 114.

Accordingly, the system 200 may provide to automate a screed adjustment process, in turn, reducing screed adjustment duration, improving process accuracy, improving paving performance, reducing labor effort, reducing process downtime, and so on. The system 200 may employ components/systems already installed on the machine 100, such as the position sensor 202, the controller 210, the screed pressure assist system 204, the extendable screed height system 206, and/or the tamper system 208, and so on, in turn, limiting an overall system cost. Also, the system 200 may be retrofitted on any machine with little or no modification to the existing system, in turn, limiting installation cost and machine downtime.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A construction machine comprising:

a frame; and a screed assembly configured to be movably coupled to the frame, the screed assembly including:

a main screed;

at least one extendable screed configured to be movably coupled with respect to the main screed;

a position sensor provided in association with the at least one extendable screed;

at least one of a screed pressure assist system operably coupled to at least one of the main screed and the at least one extendable screed, an extendable screed height system operably coupled to the at least one extendable screed, and a tamper system operably coupled to at least one of the main screed and the at least one extendable screed; and a controller communicably coupled to the position sensor and at least one of the screed pressure assist system, the extendable screed height system, and the tamper system, the controller configured to:

receive a signal indicative of a position of the at least one extendable screed with respect to the main screed;

determine a change in the position of the at least one extendable screed with respect to the main screed; and control at least one of the screed pressure assist system, the extendable screed height system, and the tamper system based, at least in part, on the determination.

2. The machine of claim 1, wherein controlling the screed pressure assist system further includes increasing an effective weight on the screed assembly based on an extension of the at least one extendable screed with respect to the main screed.

3. The machine of claim 2, wherein the screed pressure assist system includes at least one hydraulic cylinder coupled to the screed assembly, the at least one hydraulic cylinder configured to vary the effective weight on the screed assembly based on a pressure thereof.

4. The machine of claim 1, wherein to determine the change in the position of the at least one extendable screed with respect to the main screed includes determining a change in a distal end of the at least one extendable screed with respect to the main screed.

5. A screed control system for a screed assembly, the screed assembly having a main screed and at least one extendable screed, the screed control system comprising:

a position sensor provided in association with the at least one extendable screed;

at least one of a screed pressure assist system operably coupled to at least one of the main screed and the at least one extendable screed, an extendable screed height system operably coupled to the at least one extendable screed, and a tamper system operably coupled to at least one of the main screed and the at least one extendable screed; and a controller communicably coupled to the position sensor and at least one of the screed pressure assist system, the extendable screed height system, and the tamper system, the controller configured to:

receive a signal indicative of a position of the at least one extendable screed with respect to the main screed;

determine a change in the position of the at least one extendable screed with respect to the main screed; and control at least one of the screed pressure assist system, the extendable screed height system, and t tamper system based, at least in part, on the determination.

6. The screed control system of claim 5, herein controlling the screed pressure assist system further includes increasing an effective weight on the screed assembly based on an extension of the at least one extendable screed with respect to the main screed.

7. The screed control system of claim 6, wherein the screed pressure assist system includes at least one hydraulic cylinder coupled to the screed assembly, the at least one hydraulic cylinder configured to vary the effective weight on the screed assembly based on a pressure thereof.

8. The screed control system of claim 5, wherein controlling the extendable screed height system further includes lowering a height of the at least one extendable screed with respect to a ground surface based on an extension of the at least one extendable screed with respect to the main screed.

9. The screed control system of claim 8, wherein the extendable screed height system includes at least one screw drive system coupled to the at least one extendable screed, the at least one screw drive system configured to vary the height of the at least one extendable screed with respect to the ground surface based on a position thereof.

10. The screed control system of claim 5, wherein to determine the change in the position of the at least one extendable screed with respect to the main screed includes determining a change in a distal end of the at least one extendable screed with respect to the main screed.

11. A method for controlling a screed assembly associated with a constriction machine, the method comprising:

receiving a signal indicative of a position of at least one extendable screed with respect to a main screed;

determining a change in a position of the at least one extendable screed with respect to the main screed; and controlling at least one of a screed pressure assist system, an extendable screed height system, and a tamper system based, at least in part, on the determination.

12. The method of claim 11, wherein controlling the screed pressure assist system further includes increasing an effective weight on the screed assembly based on an extension of the at least one extendable screed with respect to the main screed.

13. The method of claim 11, wherein controlling the extendable screed height system further includes lowering a height of the at least one extendable screed with respect to a ground surface based on an extension of the at least one extendable screed with respect to the main screed.

14. The method of claim 11, wherein determining the change in the position of the at least one extendable screed with respect to the main screed includes determining a change in a distal end of the at least one extendable screed with respect to the main screed.

* * * * *